US009487273B1

(12) United States Patent
Eekhoff et al.

(10) Patent No.: US 9,487,273 B1
(45) Date of Patent: Nov. 8, 2016

(54) RELOCATABLE SEAT AND REMOVABLE/STORABLE SEATING ARRANGEMENT FOR BOAT

(71) Applicant: PONTOON BOAT LLC, Elkhart, IN (US)

(72) Inventors: Trent Allan Eekhoff, Grand Rapids, MI (US); Brad Roy Fishburn, Nappanee, IN (US); Jeremy Scott Warfel, Elkhart, IN (US); David A. Yoder, Elkhart, IN (US)

(73) Assignee: Pontoon Boat LLC, Elkhart, IN (US)

( * ) Notice: Subject to any disclaimer, the term of this patent is extended or adjusted under 35 U.S.C. 154(b) by 47 days.

(21) Appl. No.: 14/462,890

(22) Filed: Aug. 19, 2014

Related U.S. Application Data

(60) Provisional application No. 61/867,282, filed on Aug. 19, 2013.

(51) Int. Cl.
*B63B 29/04* (2006.01)
*A47C 4/00* (2006.01)

(52) U.S. Cl.
CPC ..... *B63B 29/04* (2013.01); *A47C 4/00* (2013.01); *B63B 2029/043* (2013.01)

(58) Field of Classification Search
CPC ... A63B 29/04; A63B 2909/043; A47C 4/00
See application file for complete search history.

(56) References Cited

U.S. PATENT DOCUMENTS

| | | | | |
|---|---|---|---|---|
| 1,646,266 | A * | 10/1927 | Stoner | B60R 7/04 297/188.07 |
| 4,709,648 | A | 12/1987 | Andrews | |
| 4,926,783 | A | 5/1990 | Lathers | |
| 5,101,753 | A | 4/1992 | Hull et al. | |
| 5,329,871 | A | 7/1994 | Gibbs | |
| 5,799,605 | A | 9/1998 | Huse | |
| 5,826,532 | A | 10/1998 | Elvestad | |
| 5,913,571 | A | 6/1999 | Dystra et al. | |
| 6,647,916 | B2 | 11/2003 | Neese et al. | |
| 6,789,494 | B2 | 9/2004 | Smith et al. | |
| 7,137,351 | B2 | 11/2006 | Picou | |
| 7,255,403 | B2 | 8/2007 | Butler | |
| 7,367,616 | B2 | 5/2008 | Summerford | |
| 7,490,896 | B2 * | 2/2009 | Smith | B60N 2/3011 297/188.04 |
| 7,513,211 | B1 * | 4/2009 | Farb | B63B 29/02 114/363 |
| 8,028,641 | B1 | 10/2011 | Sly | |
| 8,113,137 | B2 | 2/2012 | Thompson | |
| 2006/0061154 | A1 * | 3/2006 | Kahan | A47C 7/66 297/188.04 |
| 2010/0018451 | A1 | 1/2010 | Sahr | |

* cited by examiner

*Primary Examiner* — Timothy J Brindley
(74) *Attorney, Agent, or Firm* — Faegre Baker Daniels, LLP

(57) ABSTRACT

In one embodiment of the invention, a relocatable seat and removable and storable seating arrangement for use on a boat is provided. The relocatable seat has a frame, a seat bottom, a seat back, and at least one storage compartment. The removable and storable seating arrangement includes at least one removable support member, which can be stored in the storage compartment when not in use, and at least one removable seat member supported by the support member when in a use position and storable in the storage compartment in a stored position.

20 Claims, 8 Drawing Sheets

RELOCATABLE SEAT AND REMOVABLE/STORABLE SEATING ARRANGEMENT FOR BOAT

BACKGROUND OF THE INVENTION

This invention relates to a flexible sitting or lounging area on the deck of a boat, and in particular to a relocatable seat and a removable sitting or lounging area that can be stored and contained within the relocatable seat.

Boating continues to rise in popularity, increasing the desire for versatile seating, lounging, and deck arrangements on the limited deck area available. For example, U.S. Pat. No. 5,799,605 to Huse, which is incorporated in its entirety herein by reference, discloses an extendable boat seat. The seat has a base unit with a storage area and slidable frame mounted to the base to slide outwardly therefrom. The extendable seat includes cushions, wherein in a retracted position, a first cushion is in the position of the seat and a second cushion forms the back of the seat. The second cushion includes a stepped region and a reduced cross sectional area so that a portion of the cushion can be received in an interior storage area when the cushion is positioned as a seatback. When the seat is moved to an extended or lounge position, the first cushion moves forward to the foot area and the back cushion becomes the seat cushion.

U.S. Patent Application Publication No. 2010/0018451 to Sahr, which is incorporated in its entirety herein by reference, discloses a convertible seat/deck arrangement for a boat. The convertible seat elements can be pivoted upward to provide additional horizontal seating/lounging area. When the elements are in the horizontal position, foldable legs are placed generally perpendicular to the deck to support the horizontal elements. The elements can be pivoted to a vertical position located beneath the seat and the cushions located behind the leg area.

U.S. Pat. No. 4,926,783 to Lathers, which is incorporated in its entirety herein by reference, discloses a folding seat for use in a boat. The seat has a folded vertical position, an intermediate position, and an extended position including an extension cushion and leg support.

U.S. Pat. No. 5,329,871 to Gibbs, which is incorporated in its entirety herein by reference, discloses a swivel pedestal seat for a boat that includes a post for receipt of the seat and a bracket. The bracket permits the seat to remain in a normally upright position, but also to be pivoted into a lower center of gravity position adjacent the deck.

U.S. Pat. No. 5,913,571 to Dystra et al., which is incorporated in its entirety herein by reference, discloses a marine seating apparatus having a one piece base to which a seat is affixed. The seat has a back portion divided into an upper and lower part by a living hinge and a bench portion. In one embodiment, a footrest portion is also included. The footrest and bench portions are integrally formed and are separated by another living hinge. In a standard position, the footrest is contained within the storage area of the seat, and the seat can be pivoted to unfold the footrest for use thereof.

U.S. Pat. No. 6,789,494 to Neese et al., which is incorporated in its entirety herein by reference, discloses a fold out seat assembly attached to a support structure on a vertical mounting surface. The seat assembly has two sections including a back rest fixedly attached to the mounting surface above the seat assembly and a seat unit that is movable from a vertical stored position against the mounting surface to a horizontal seating position. Major portions of the seat unit are also detachable from the mounting surface when not needed.

U.S. Pat. No. 7,255,403 to Butler, which is incorporated in its entirety herein by reference, discloses a seat assembly for use in a watercraft. The seat assembly is designed to provide take-down seating and includes a first portion, a second portion, spaced from the first portion, and connector panels that are separable from and interconnect the first and second portions. A plurality of locking tabs extend from each of the connector panels for insertion into slots. A mounting bracket is attached to a base of each of the connector panels and perpendicularly extends the connector panels to mount the panels to the deck to thereby secure the first and second portions to the deck.

U.S. Pat. No. 7,367,616 to Summerford, which is incorporated in its entirety herein by reference, discloses a folding boat seat mountable to a vertical mounting surface such as the bulkhead of a boat. The system includes a seat, a pair of guide followers extending from opposite sides of the seat, a pair of guides mountable to the mounting surface and configured to receive the guide followers. A substantially U-shaped frame member having opposite ends is pivotally mounted adjacent the guide followers, and a pair of bias struts, each having a first end pivotally mounted adjacent one of the guides and a second end pivotally mounted to support the seat.

U.S. Pat. No. 8,028,641 to Sly, which is incorporated in its entirety herein by reference, discloses a convertible bench seat/platform for pontoon boats. The convertible bench seat is pivotally connected to the deck of a pontoon boat and is movable between an inboard position adjacent to the boat side rail for use as a bench seat and an outboard position for use as a platform for fishing, sitting, diving, and swimming.

U.S. Pat. No. 8,113,137 to Thompson, which is incorporated in its entirety herein by reference, discloses a folding seat with a movable backrest. The movable seat and backrest are coupled by a pivot link, allowing the seat to pivot from a raised stowed position to a lowered use position. A connecting link is coupled to one of the pivot seat links, such that as the seat is lowered, the connecting link raises the backrest. When the seat is raised to a stowed position, the connecting link lowers the backrest to a lowered position. When mounted in a vessel, the backrest forms part of the bolster system when the seat is stowed.

The subject invention discloses a relocatable seat and a removable seating/lounging area and mounting brackets therefor that are storable in the relocatable seat.

SUMMARY OF THE INVENTION

In one embodiment of the invention, a relocatable seat and removable and storable seating arrangement for use on a boat is provided. The relocatable seat has a frame, a seat bottom, a seat back, and at least one storage compartment. The removable and storable seating arrangement includes at least one removable support member, which can be stored in the storage compartment when not in use, and at least one removable seat member supported by the support member when in a use position and storable in the storage compartment in a stored position.

The relocatable seat may have a storage compartment located beneath the seat bottom. The seat bottom may be pivoted on a hinged connection for access to the storage compartment. A second storage compartment may be located in the rear of the seat back, the second storage compartment may have a pivoting door for allowing access thereto.

The relocatable seat and removable and storable seating arrangement may include holders configured to hold the support member when in the stored position. The support member may be folded along a length thereof and may have a hinge and may be folded about the hinge.

In one embodiment, the seating arrangement includes three foldable support members. The support members may be mounted on seats adjacent the relocatable seat when the support members are in the use position. Mounting members may be attached to frames of the seats adjacent the relocatable seat for receipt of and support of the support members. Seat members may be stored in the storage compartment below the seat bottom when not in use. They may also extend between adjacent seats on the support members when in a use position.

The seating arrangement may also include three foldable support members which may be stored in respective holders attached to the inside surface of the pivoting door covering the second storage compartment. The pivoting door may be connected to the frame of the relocatable seat with a hinged connection at a bottom edge of the door.

The relocatable seat may be configured to be located between sections of either stern or bow seating arrangements and adjacent a gate or railing of the boat. The support members and seat members may be configured to be mounted in front of said relocatable seat and between the sections of the bow or stern seating arrangement.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
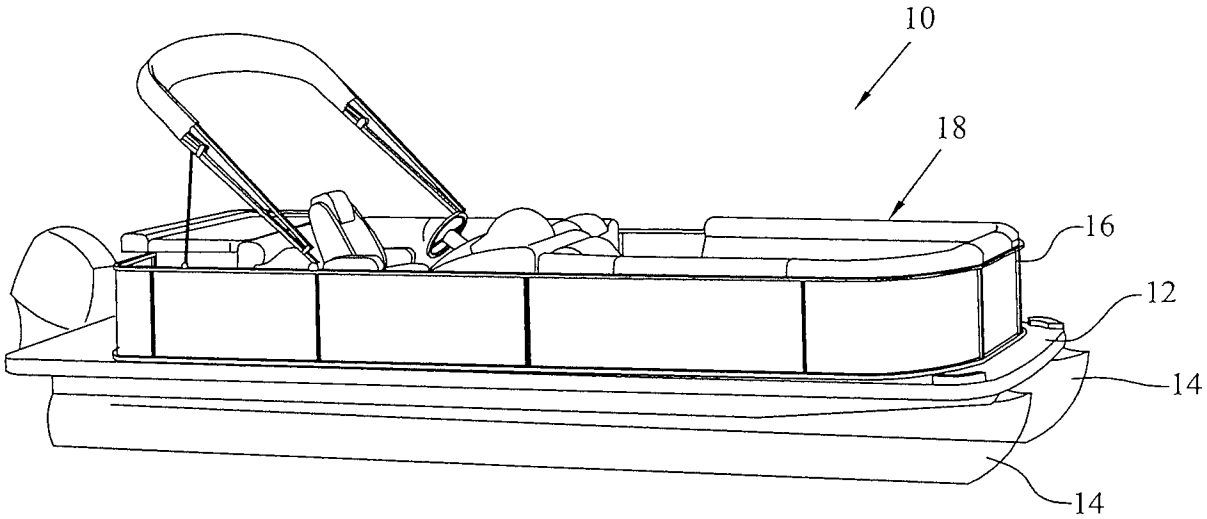
FIG. 1 is a perspective view of a boat including a relocatable seat and removable/storable arrangement in accordance with the subject invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIG. 1, a boat is shown, generally indicated as 10. Boat 10, as depicted, is a variety commonly referred to as a pontoon boat and is well known; however, it should be appreciated that the present invention may be utilized on other types of boats and is not restricted for use on a pontoon boat. In the embodiment shown, pontoon boat 10 includes a deck 12, a pair of pontoons 14, a railing 16 extending about deck 12, and a plurality of seats, generally indicated as 18.

Figure 2:
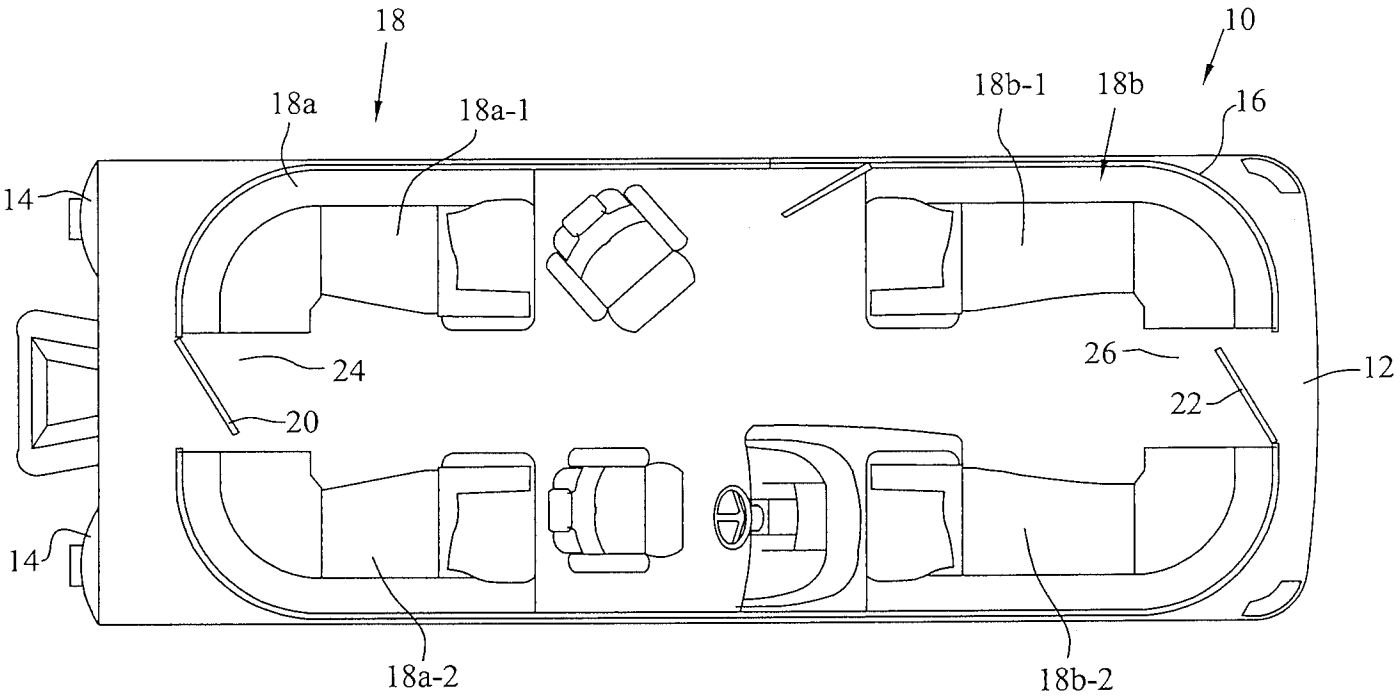
FIG. 2 is a plan view of the boat of FIG. 1, with the relocatable seat and removable/storable seating arrangement removed.

Now referring to FIG. 2, boat 10 includes a stern seating arrangement, generally indicated as 18*a*, and a bow seating arrangement, generally indicated as 18*b*. Stern seating arrangement 18*a* includes opposing sections 18*a*-1 and 18*a*-2, and bow seating arrangement 18*b* includes opposing sections 18*b*-1 and 18*b*-2. In the embodiment shown, sections 18*a*-1 and 18*b*-2 are mirror images of sections 18*a*-2 and 18*b*-2, respectively, about a longitudinal access of boat 10 and are spaced apart from one another on deck 12. Also shown in FIG. 2 is a stern gate 20 and bow gate 22 on railing 16.

Sections 18*a*-1 and 18*a*-2 define a space 24 therebetween where gate 20 can open into, and sections 18*a*-1 and 18*b*-2 define a space 26 where a bow gate 22 can open into.

Figure 4:
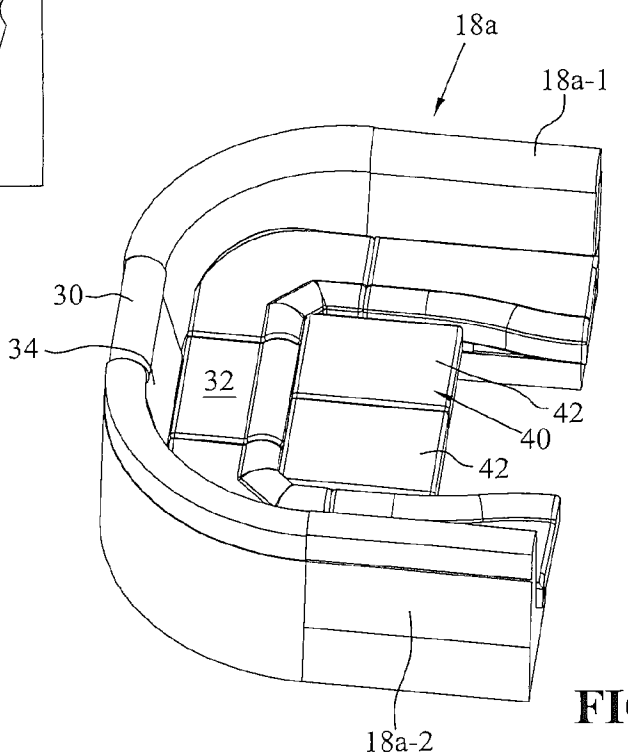
FIG. 4 is a side perspective view showing the relocatable seat and removable/storable seating arrangement in the use position.
Figure 3:
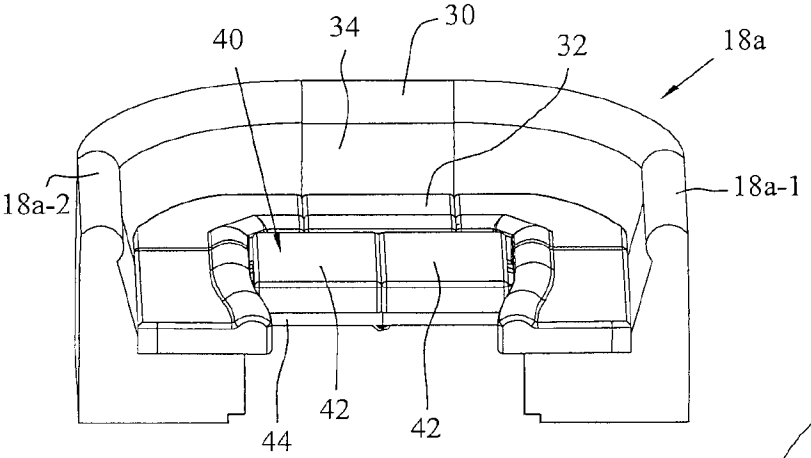
FIG. 3 is a front view showing the relocatable seat removed from the boat and the removable/storable seating arrangement in a use position.
Figure 5:
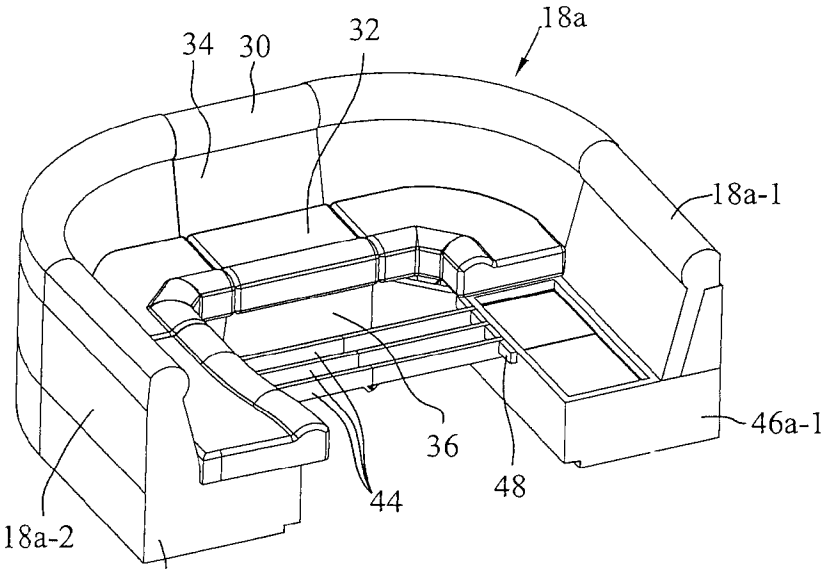
FIG. 5 is a perspective view showing the removable/storable seat removed, but with support members in place to support the seating arrangement.

Now referring to FIGS. 3-5, stern seating arrangement 18*a* is shown removed from boat 10 for clarity. In these figures, a relocatable seat 30 has been placed in space 24 between sections 18*a*-1 and 18*a*-2. Relocatable seat 30 includes a seat bottom 32, a seat back 34, and a frame 36 (see FIG. 5).

In front of relocatable seat 30 and between sections 18*a*-1 and 18*a*-2 a removable and storable seating arrangement, generally indicated as 40, is shown. Seating arrangement 40 includes a pair of seat members or cushions 42 and support members or brackets 44, which can be removed and stored within a storage compartment in relocatable seat 30 when not in use. In FIG. 5, seat members 42 have been removed to better show support members 44, of which there are three in the subject embodiment. Support members 44 extend between frames 46*a*-1 and 46*a*-2 of sections 18*a*-1 and 18*a*-2, respectively. Brackets, slots or other mounting members 48 are attached to frames 46*a*-1 and 46*a*-2 for receipt of and support of support members 44.

As will be discussed in further detail below, support members 44 of seating arrangement 40 are mounted to sections 18*a*-1 and 18*a*-2 as facilitated by mounting members 48 when seating arrangement 40 is in an employed or use position. Should it be desired to remove seating arrangement 40 to provide additional deck area on deck 12, both seat members 42 and support members 44 may be stored in storage compartments contained in relocatable seat 30 as discussed below in further detail. It should also be appreciated that, while the subject inventive and storable seating arrangement is shown mounted to stern seating arrangement 18*a*, it may just as readily be used and installed in bow seating arrangement 18*b* instead of or in addition to in the stern.

It should be appreciated that when seating arrangement 40 is in the use position shown in FIGS. 3 and 4, additional seating or lounging area is provided to stern seating arrangement 18*a* for enjoyment and use by passengers.

Figure 6:
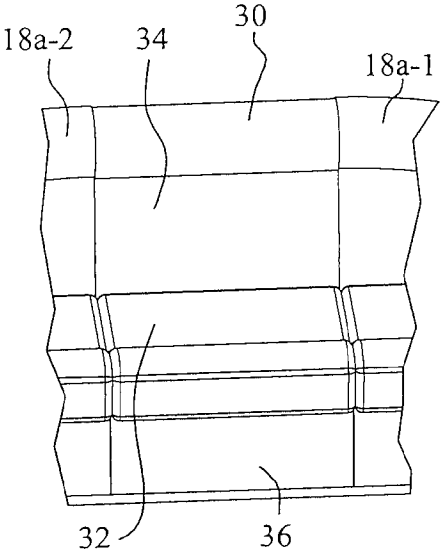
FIG. 6 is a front view of the relocatable seat in place on the boat of FIG. 1, but the removable/storable seating arrangement and support members removed.
Figure 7:
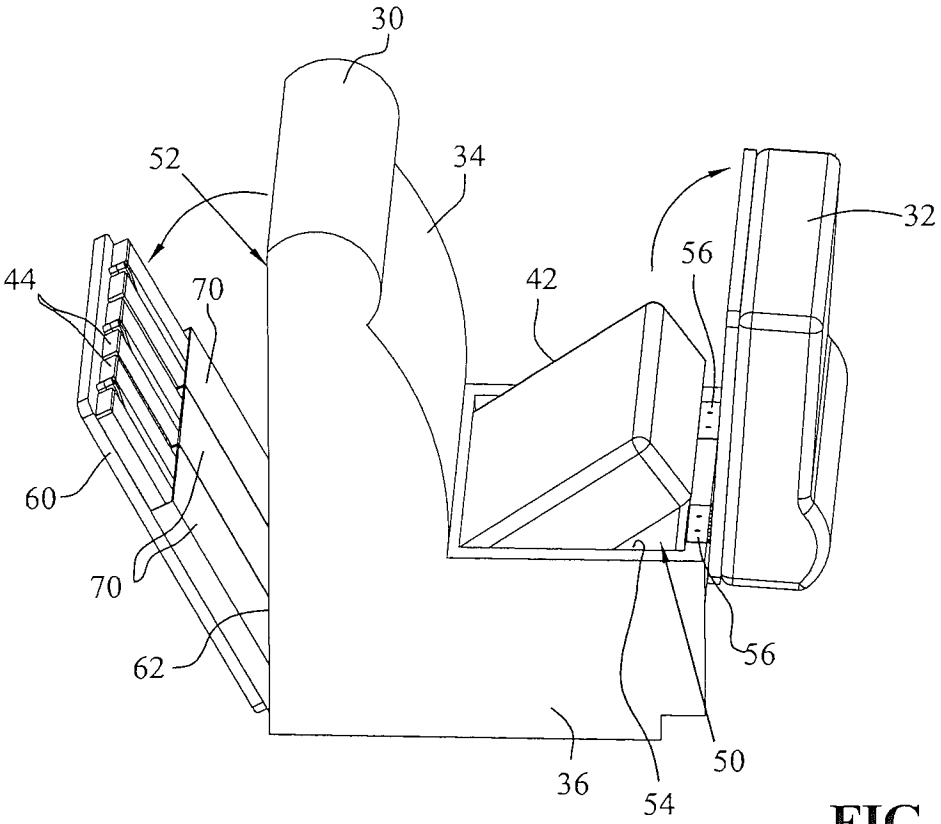
FIG. 7 is a side perspective view of the relocatable seat removed from the boat and showing a storage arrangement for the support members and seat members of the removable/storable seating arrangement.

Referring now to FIG. 6, the front view of relocatable seat 30 is shown with removable seating arrangement 40 removed. In this position, relocatable seat 30 forms a generally U-shaped configuration with sections 18*a*-1 and 18*a*-2 of stern seating arrangement 18*a*.

Now referring to FIGS. 7-11, relocatable seat 30 is shown removed from seating arrangement 18*a* to better show storage compartments for storing removable seating arrangement 40, when not in use. In the embodiment shown, relocatable seat 30 includes a first storage compartment, generally indicated as 50, which is located beneath and accessible by moving seat bottom 32 and a second storage compartment, generally indicated as 52, which is accessible through a door behind seat back 34. To provide space for storage compartments 50 and 52, it should be appreciated that the area underneath seat bottom 32 and behind seat back 34 and between frame 36 is generally hollow. An opening 54 is provided in frame 36 for access to storage compartment 50. Furthermore, seat bottom 32 is mounted to frame 36 with hinged connections 56 at a front end of seat 30 so that seat bottom 32 may be pivoted upward and forward (see FIGS. 7 and 8) about hinged connections 56 to provide access to opening 54 and first storage compartment 50. In the embodiment shown, storage compartment 50 is configured to receive seat members 42 of seating arrangement 40 for storage when not in use.

Figure 9:
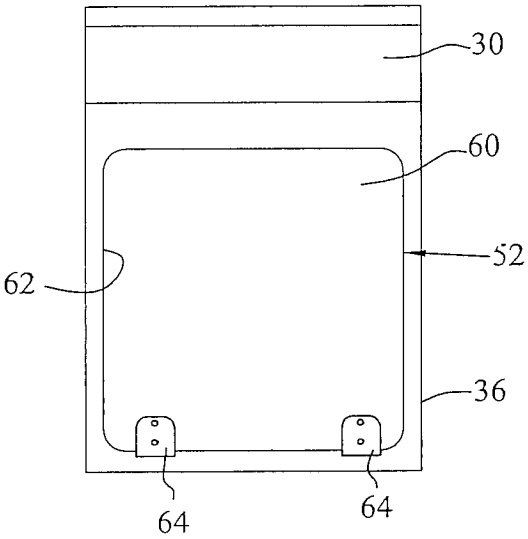
FIG. 9 is a rear view of the relocatable seat with the support members storage compartment door closed.
Figure 8:
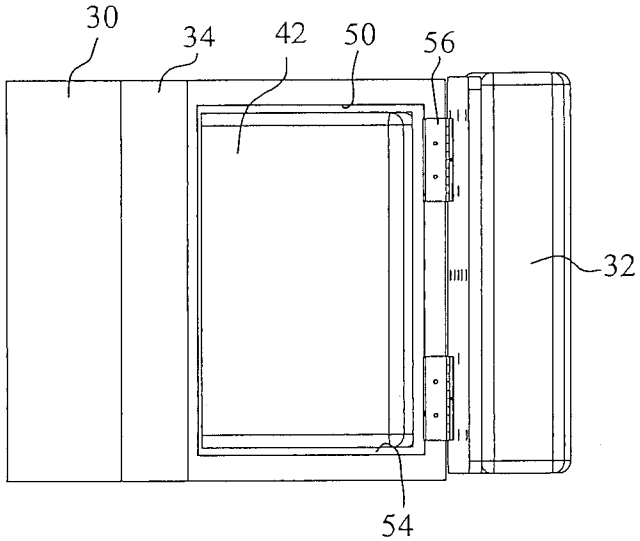
FIG. 8 is a plan view showing the seat members of the removable/storable seating arrangement stored in the relocatable seat.
Figure 11:
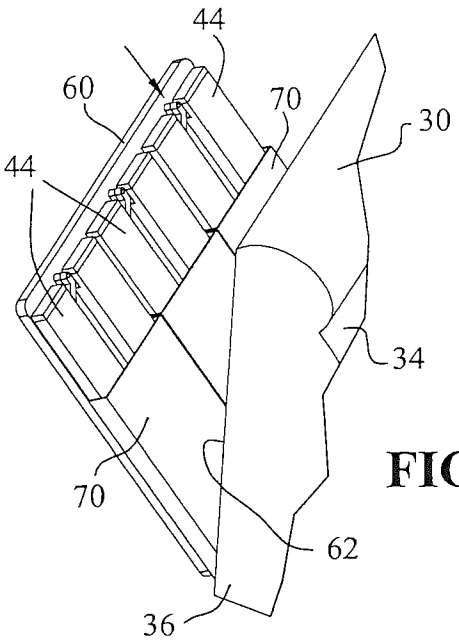
FIG. 11 is a perspective view with the support members completely inserted for storage thereof.
Figure 10:
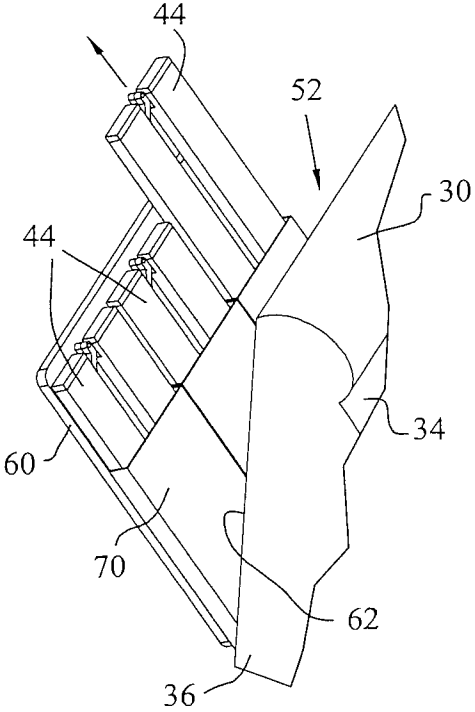
FIG. 10 is a perspective view showing the support members being stored in the relocatable seat.

A pivoting door 60 covers an opening 62 for access into the second storage compartment 52. Door 60 is connected to frame 36 with hinges or hinged connection 64 as shown in FIG. 9.

Relocatable seat 30 also includes a plurality of holders 70 for receiving support members 44 for storage thereof. Holders 70 are mounted to an interior surface of door 60 and include an opening at the top of each holder for receiving a respective support member 44 when removable seating arrangement 40 is not in use. For storage in holder 70 and second storage compartment 52, support members 44 are folded in half as discussed in greater detail below. It should be appreciated that other types of holders may readily be used instead of the holder shown in the depicted embodiment. For example, flexible straps may be used to hold the support members or a single compartment may be provided to store all of the support members.

Figure 13:
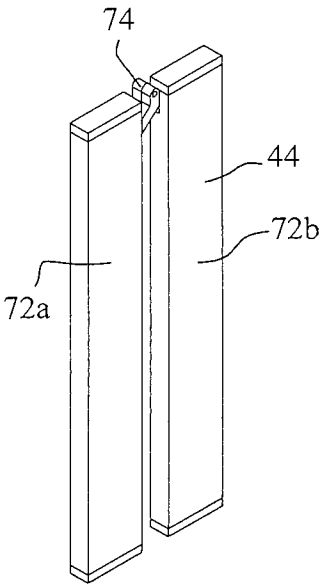
FIG. 13 is a perspective view of the support member of FIG. 12 shown in a folded storage position.
Figure 12:
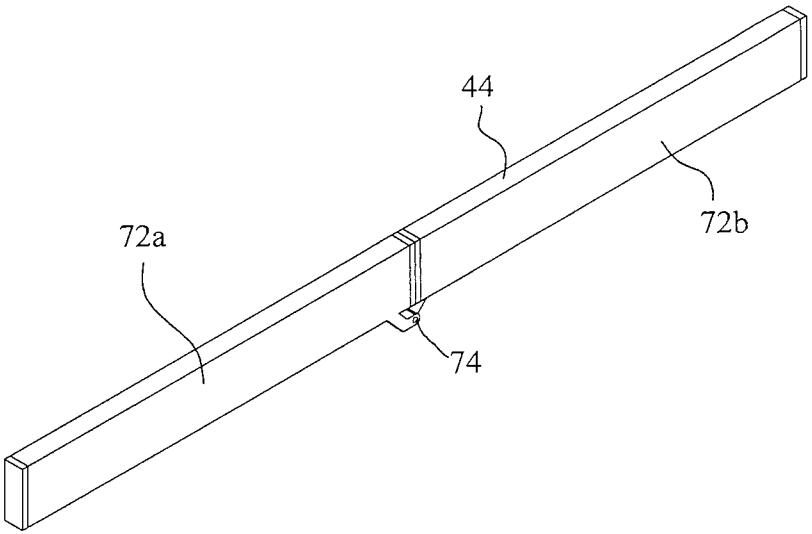
FIG. 12 is a perspective view of one of the support members shown in an extended, unfolded use position.

Now referring to FIGS. 12 and 13, further details of support members 44 are shown. Support members 44 may be manufactured from any suitable material, such as steel, aluminum, or a sufficient strength resin member. In the embodiment shown, support members 44 include two aligned longitudinally extending sections 72*a* and 72*b*. Sections 72*a* and 72*b* are connected to one another with a hinge 74 attached to lower side edges and adjacent ends of the sections. Support member 44 is shown in the use position in FIG. 12, and as should be appreciated, with hinged connection 74 located at the lower side edges of sections 72*a* and 72*b*, support member 44 can receive a downward compressive force along the upper edges (as occurs when a person sits or lays on seat members 42 when in the use position) without causing folding or buckling of the support member. However, when it is desired to store removable seating arrangement 40 and support members 44, the outer ends of sections 72*a* and 72*b* can be removed from mounting supports 48*a*, and sections 72*a* and 72*b* folded downwardly about hinge 74 to the stored or folded position as shown in FIG. 13. In the folded position, support members 44 fit readily into holders 70 and within the second storage compartment 52 of relocatable seat 30.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. As such, the scope of the invention is indicated by the following claims rather than by the description.

The invention claimed is:

1. A relocatable seat and removable and storable seating arrangement utilized on a boat, comprising:

a boat having a bow and a stern;

a relocatable seat having a frame, a seat bottom, a seat back, and at least one storage compartment, the seat being relocatable between two open spaces in the boat, one space in the bow and the other space in the stern of the boat;

two other seats located adjacent said relocatable seat, said other seats separated by a distance;

at least one removable support member, which can be stored in one of said at least one storage compartment when not in use and when in a use position said at least one removable support member spanning across the distance between said two other seats and abutting and supported by said two other seats, said at least one support member having an adjustable length, including a storage length that is shorter than the distance separating said two other seats; and at least one removable seat member supported by said at least one support member when in a use position and storable in one of said at least one storage compartment in a stored position.

2. The relocatable seat and removable and storable seating arrangement as set forth in claim 1, wherein the relocatable seat has one of said at least one storage compartment located beneath the seat bottom.

3. The relocatable seat and removable and storable seating arrangement as set forth in claim 2, wherein said seat bottom is attached to said frame with a hinged connection, and said seat bottom is pivoted on said hinged connection for access to said one of said at least one storage compartment.

4. The relocatable seat and removable and storable seating arrangement as set forth in claim 3, wherein another of said at least one storage compartment is located behind said seat back.

5. The relocatable seat and removable and storable seating arrangement as set forth in claim 4, wherein said another of said at least one storage compartment has a pivoting door for allowing access thereto.

6. The relocatable seat and removable and storable seating arrangement as set forth in claim 5, including holders mounted in said one or said another of said at least one storage compartment configured to hold said at least one support member when in the stored position.

7. The relocatable seat and removable and storable seating arrangement as set forth in claim 1, wherein said at least one support member is foldable along a length thereof.

8. The relocatable seat and removable and storable seating arrangement as set forth in claim 7, wherein said at least one support member includes a hinge and said support member folds about said hinge.

9. The relocatable seat and removable and storable seating arrangement as set forth in claim 8, wherein the seating arrangement includes three foldable support members.

10. The relocatable seat and removable and storable seating arrangement as set forth in claim 8, wherein said hinge on said at least one support member supports downward pressure without folding about said hinge when in the use position.

11. The relocatable seat and removable and storable seating arrangement as set forth in claim 10, including mounting members attached to frames of said two other seats adjacent said relocatable seat for receipt of and support of said at least one support member.

12. The relocatable seat and removable and storable seating arrangement as set forth in claim 2, wherein said at least one seat member is storable in one of said at least one storage compartment below said seat bottom when not in use.

13. The relocatable seat and removable and storable seating arrangement as set forth in claim 12, wherein said at least one seat member extends between said two other adjacent seats on said at least one support member when in a use position.

14. The relocatable seat and removable and storable seating arrangement as set forth in claim 6, wherein there are three foldable support members storable in respective holders attached to an inside surface of said pivoting door covering said another of said at least one storage compartment.

15. The relocatable seat and removable and storable seating arrangement as set forth in claim 14, wherein said pivoting door is connected to said frame of said relocatable seat with a hinged connection at a bottom edge of said door.

16. The relocatable seat and removable and storable seating arrangement as set forth in claim 1, wherein said relocatable seat is configured to be located between sections of either stern or bow seating arrangements and adjacent a gate or railing of the boat.

17. The relocatable seat and removable and storable seating arrangement as set forth in claim 16, wherein said at least one support member and seat members are configured to be mounted in front of said relocatable seat and between said sections of said bow or stern seating arrangement.

18. A relocatable seat and removable and storable seating arrangement utilized on a boat, comprising:

a boat having a bow and a stern;

a relocatable seat having a frame, a seat bottom, a seat back, and at least one storage compartment, the seat being relocatable between two open spaces in the boat, one space in the bow and the other space in the stern of the boat;

a plurality of removable support members configured to be supported by a frame external to said relocatable seat and further configured to be stored in one of said at least one storage compartment when not in use, said removable support members having a longer in use length and a shorter compacted storage length, said removable support members configured to be storable in respective holders attached to an inside surface of a pivoting door covering one of said at least one storage compartment; and at least one removable seat member supported by said support members and located adjacent said seat bottom when in a use position, and storable in one of said at least one storage compartment in a stored position.

19. A relocatable seat and removable and storable seating arrangement as set forth in claim 18 wherein said support members have a foldable hinged connection and are unfolded in the longer use position and folded to the shortened compacted length in the stored position.

20. A relocatable seat and removable and storable seating arrangement as set forth in claim 19 including mounting members mounted to the frame external to the relocatable seat for supporting said removable support members when in the use position.

* * * * *